US006322377B2

(12) United States Patent
Middlehurst et al.

(10) Patent No.: US 6,322,377 B2
(45) Date of Patent: Nov. 27, 2001

(54) CONNECTOR AND MALE ELECTRICAL CONTACT FOR USE THEREWITH

(75) Inventors: Richard J. Middlehurst; Donald E. Wood, both of Fremont; Robert S. Jetter, Oakland; Robert G. Foley, Fremont, all of CA (US)

(73) Assignee: TVM Group. Inc., Fremont, CA (US)

( * ) Notice: Subject to any disclaimer, the term of this patent is extended or adjusted under 35 U.S.C. 154(b) by 0 days.

(21) Appl. No.: 09/834,853

(22) Filed: Apr. 12, 2001

Related U.S. Application Data

(63) Continuation of application No. 09/344,821, filed on Jun. 25, 1999.
(60) Provisional application No. 60/100,392, filed on Sep. 15, 1998.

(51) Int. Cl.[7] ..... H01R 12/00
(52) U.S. Cl. ..... 439/79; 439/947
(58) Field of Search ..... 439/79, 80, 947, 439/83

(56) References Cited

U.S. PATENT DOCUMENTS

| | | | |
|---|---|---|---|
| D. 366,239 | | 1/1996 | Eaton . |
| D. 366,241 | | 1/1996 | Eaton . |
| D. 366,454 | | 1/1996 | Eaton . |
| D. 368,071 | | 3/1996 | Eaton . |
| D. 372,220 | | 7/1996 | Matthews . |
| D. 405,417 | | 2/1999 | Matthews . |
| 2,671,205 | | 3/1954 | Wermine . |
| 3,208,030 | * | 9/1965 | Evans et al. ..... 439/290 |
| 3,264,599 | | 8/1966 | Kinkaid . |
| 3,555,497 | | 1/1971 | Watanabe . |
| 4,749,357 | | 6/1988 | Foley . |
| 4,824,380 | | 4/1989 | Matthews . |
| 5,336,117 | | 8/1994 | Mizuguchi et al. . |
| 5,370,556 | | 12/1994 | Olsson . |
| 5,431,576 | | 7/1995 | Matthews . |
| 5,575,690 | | 11/1996 | Eaton . |
| 5,667,392 | | 9/1997 | Kocher et al. . |
| 5,997,347 | | 12/1999 | Robinson et al. . |

OTHER PUBLICATIONS

JEE, Spotlighting: Connectors, p. 34, Feb. 1988.

* cited by examiner

*Primary Examiner*—Neil Abrams
(74) *Attorney, Agent, or Firm*—Flehr Hohbach Test Albritton & Herbert LLP

(57) ABSTRACT

A connector for use with a printed circuit board having a plurality of traces extening to an array of interconnect holes. The connector includes a connector housing adapted for mounting to the printed circuit board in a position overlying the array of interconnect holes and at least one male connector means of an electrically conductive material carried by the male connector housing. The male connector means is formed from a unitary body having first and second blade members and first and second central members. Each of the first and second blade members extends in juxtaposition and has first and second ends. The first ends of the first and second blade members are joined together to form a forward end of the male connector means and the second ends of the first and second blade members are joined to respective first and second central members. The first and second central members are spaced apart and each has an end. The unitary body includes a plurality of pin members extending from the end of each of the first and second central members for engaging the array of interconnect holes in the circuit board.

9 Claims, 11 Drawing Sheets

CONNECTOR AND MALE ELECTRICAL CONTACT FOR USE THEREWITH

CROSS-REFERENCE TO RELATED APPLICATIONS

This application is a continuation of U.S. patent application Ser. No. 09/344,821 filed Jun. 25, 1999, which claims benefit of U.S. Provisional Application Ser. No. 60/100,392 filed Sep. 15, 1998, the entire contents of each of which are incorporated herein by this reference.

BRIEF DESCRIPTION OF THE INVENTION

This invention relates to electrical connector assemblies and more particularly to electrical connector assemblies for power distribution and signal circuit interconnections between printed circuit boards.

BACKGROUND OF THE INVENTION

Connector assemblies having cooperatively-engaging male and female connectors have heretofore been used for providing electrical connections between printed circuit boards. See, for example, U.S. Pat. No. Des. 408,361. Such connector assemblies can serve to transmit power and/or electrical signals. A variety of pins, blades or other male electrically conductive bodies and sockets or other female electrically conductive bodies are utilized in such connector assemblies for transmitting electrical energy or signals. Exemplary electrically conductive bodies for transmitting electrical energy are disclosed in U.S. Pat. Nos. 4,749,357, 4,824,380, 5,431,576, 5,575,690, Des. 366,239, Des. 366, 241, Des. 366,454, Des. 368,071, Des. 372,220 and Des. 405,417. Many of such existing electrically conductive bodies are made from multiple parts, which can increase the resistivity and thus decrease the efficiency of the electrically conductive body.

There is a continual need for smaller connector assemblies of the same capability as existing connector assemblies. An improved connector assembly would ideally be relatively small in size and have a relatively small profile with respect to the printed circuit boards. The electrically conductive bodies utilized in such a connector assembly would preferably be formed from a minimal number of parts.

SUMMARY OF THE INVENTION

The invention provides a low profile connector assembly for use with a first printed circuit board having a plurality of first traces extending to an array of interconnect holes and a second printed circuit board having a plurality of second traces extending to an array of interconnect holes. The connector assembly comprises an elongate male connector housing extending along a longitudinal axis and having a first side extending parallel to the longitudinal axis adapted for mounting to the first printed circuit board in a position overlying the array of interconnect holes of the first printed circuit board. The male connector housing has a second side and a cavity communicating with an opening in the second side. A plurality of male connector means of an electrically conductive material are carried by the male connector housing. The male connector means have respective blades disposed completely within the cavity in longitudinally spaced-apart positions and accessible from the opening and respective pluralities of pin members extending from the first side for disposition within respective arrays of interconnect holes. An elongate female connector housing having a first side adapted for mounting to the second printed circuit board is included in the connector assembly. The female connector housing has a size and shape for at least partially seating within the cavity when the male and female connector housings are interconnected. A plurality of female connector means of an electrically conductive material are carried by the female connector housing. The female connector means has respective socket portions for receiving the blades when the male and female connector housings are interconnected and respective pluralities of pin members extending from the first side of the female connector housing for disposition within respective arrays of interconnect holes in the second printed circuit board. The female connector means and the male connector means serve to transmit power between the printed circuit boards.

DETAILED DESCRIPTION OF THE INVENTION

Reference will now be made in detail to the preferred embodiment of the invention which is illustrated in the accompanying figures. The description of the embodiment of the invention will be followed by a discussion of its operation.

Figure 1:
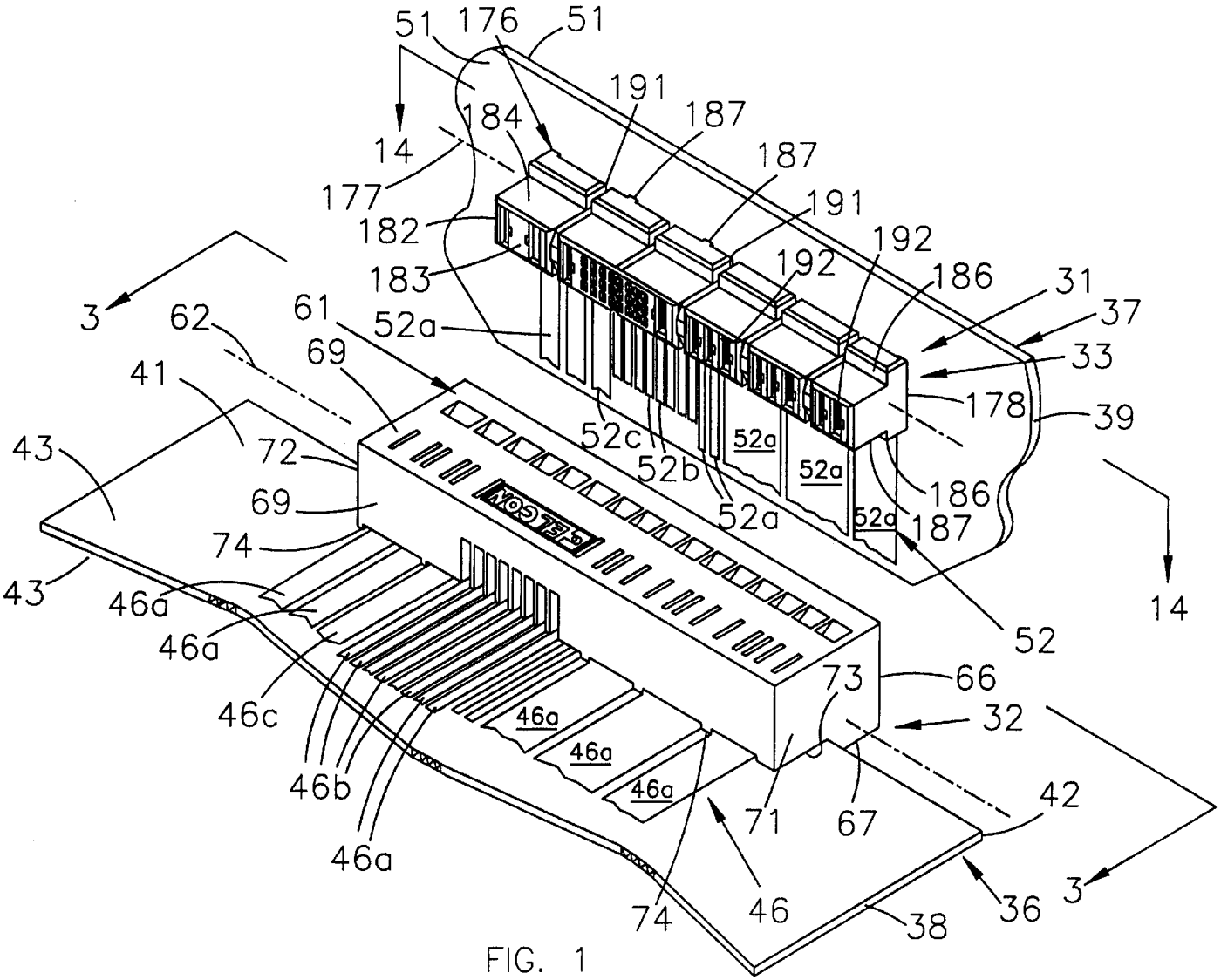
FIG. 1 is a perspective view of the male and female connectors of the low profile connector assembly of the present invention mounted on respective printed circuit boards in an unengaged position.
Figure 2:
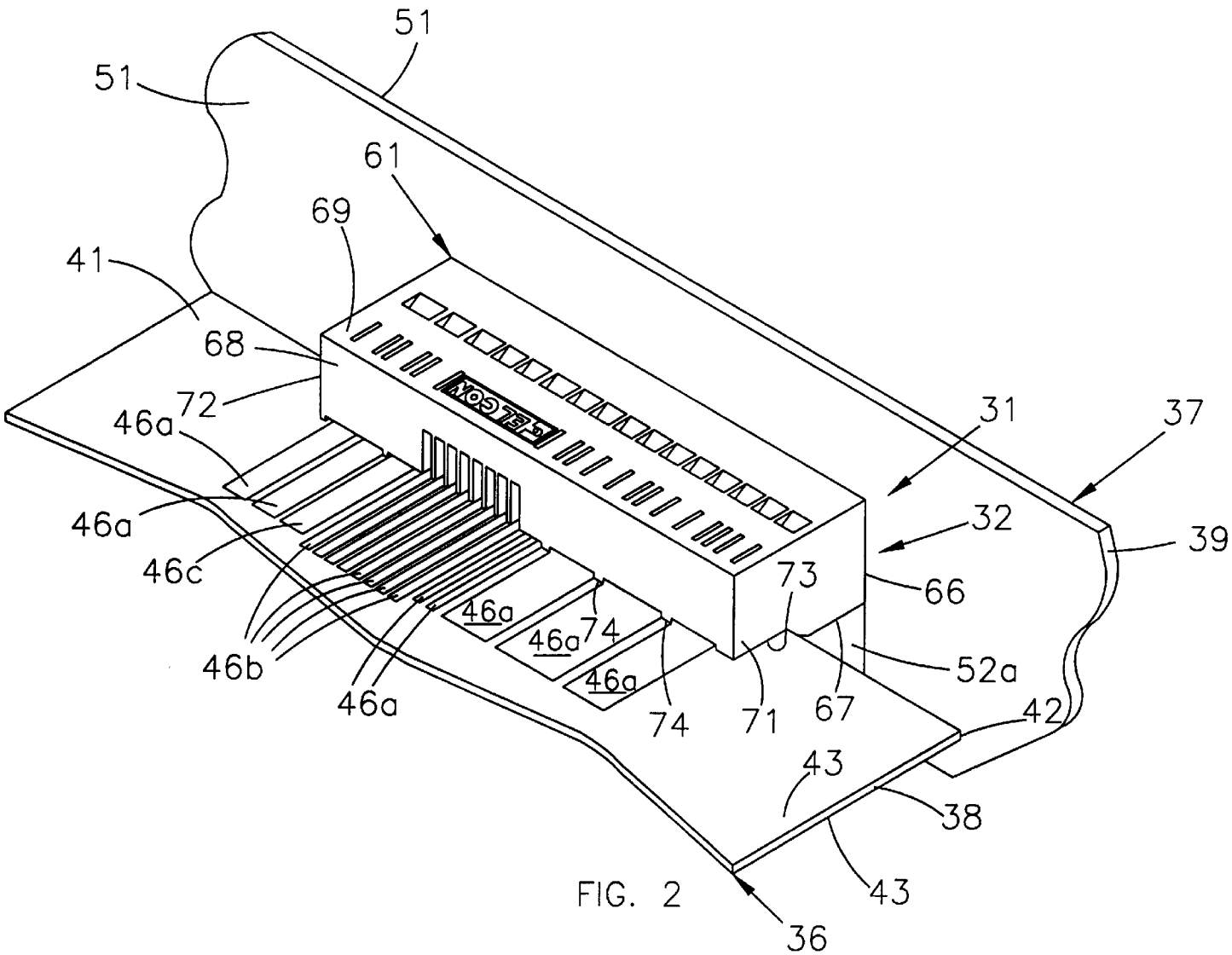
FIG. 2 is a perspective view of the male and female connectors of the low profile connector of FIG. 1 in an engaged position.

The connector assembly 31 of the present invention is a low profile connector assembly formed from a male connector 32 and a female connector 33 (see FIGS. 1 and 2). Connector assembly 31 serves to transmit power and electrical signals between first and second printed circuit boards. In this regard, male connector 32 is adapted to mount to a first printed circuit board 36 and female connector 33 is adapted to mount to a second printed circuit board 37. Each of the printed circuit boards is of a conventional design and are formed from respective planar sheets 38 and 39 made from any suitable materials such as glass reinforced epoxy laminate (FR4).

Figure 3:
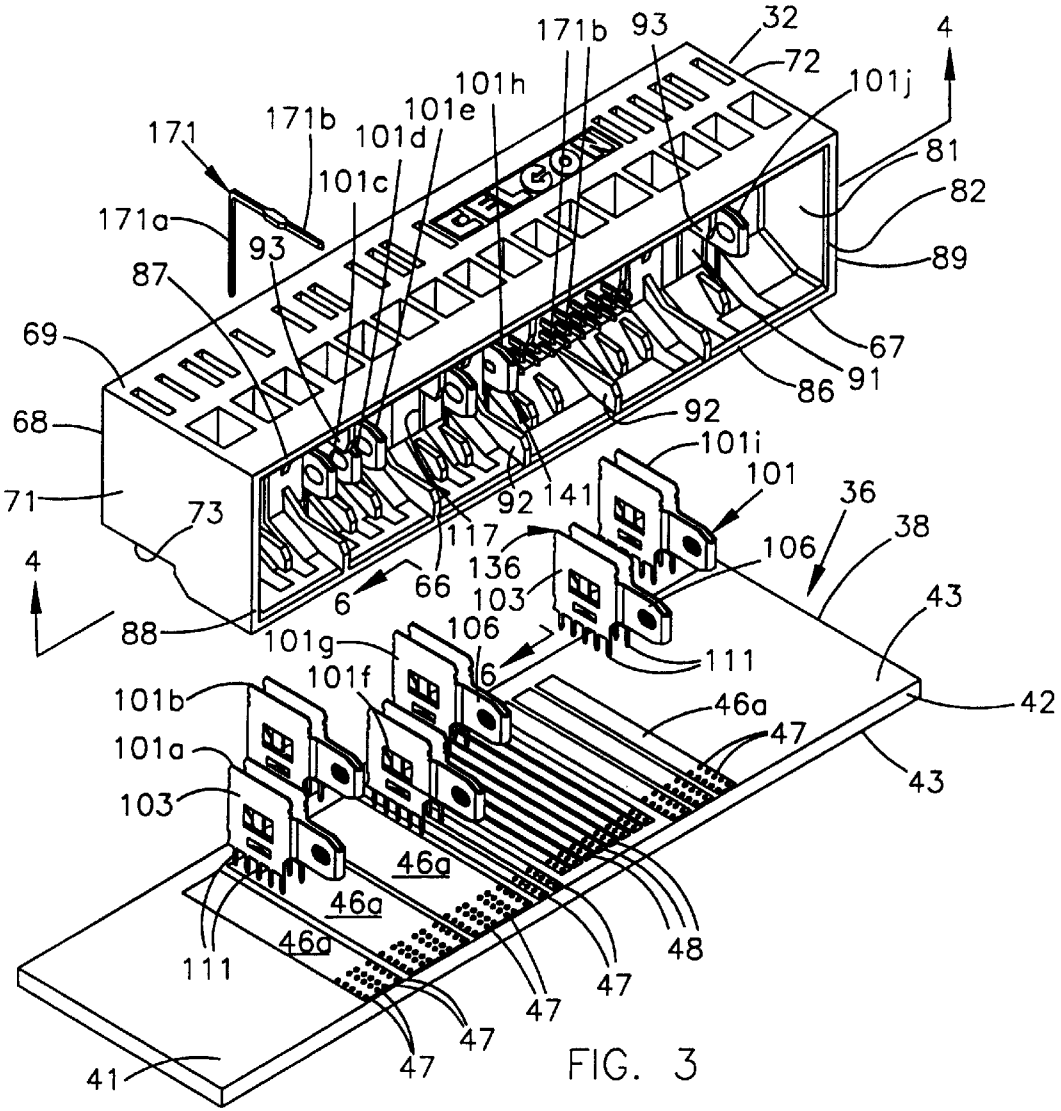
FIG. 3 is a partially exploded perspective view of the male connector of FIG. 1 taken generally along the line 3—3 of FIG. 1.

First sheet 38 has an end portion 41 adjacent a linear edge 42 and opposite top and bottom parallel surfaces 43 which extend from end 42 (see FIGS. 1 and 3). A plurality of traces 46 made from copper or any other suitable material are carried by first sheet 38 and, in the illustrated embodiment, are formed on top surface 43. It should be appreciated that traces 46 can be formed on top and/or bottom surface 43 and can also extend internally of the first sheet 38. The traces 46 include a plurality of power traces 46*a* for carrying electrical energy or power, signal traces 46*b* for carrying electrical signals and a ground trace 46*c*. Traces 46 preferably extend along the top surface 43 to spaced-apart positions located in end portion 41. Adjacent power traces 46*a* are preferably spaced apart from each other a distance based on regulation specifications for safe voltage operation. An array of interconnect holes 47 extend through sheet 38 and each power trace 46*a* and the ground trace 46*c* at end portion 41 and preferably include one of more plurality of spaced-apart interconnect holes 47 arranged in series along a portion of the length of the trace. In one preferred embodiment, one or more plurality of five longitudinally spaced-apart interconnect holes are provided in the end of each power trace 46*a* and the ground trace 46*c*. An array of interconnect holes 48 is similarly provided in signal traces 46*b*. In one embodiment, a plurality of three longitudinally spaced-apart interconnect holes 48, each substantially similar to interconnect hole 47, extend through the end of each signal trace 46*b* and first sheet 38. Each interconnect hole 47 and 48 has a diameter of approximately 0.040 inch. The preferred spacing between interconnect holes 47 is 2.5 millimeters.

Figure 10:
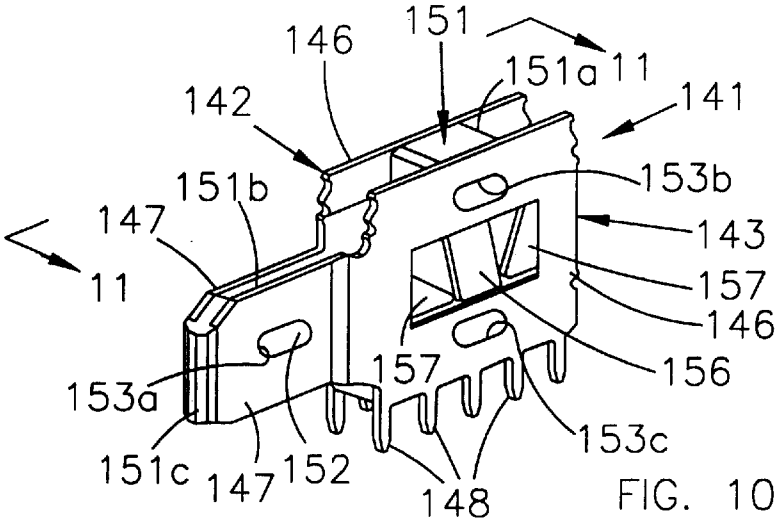
FIG. 10 is a perspective view of a split contact blade of the male connector of FIG. 1.
Figure 12:
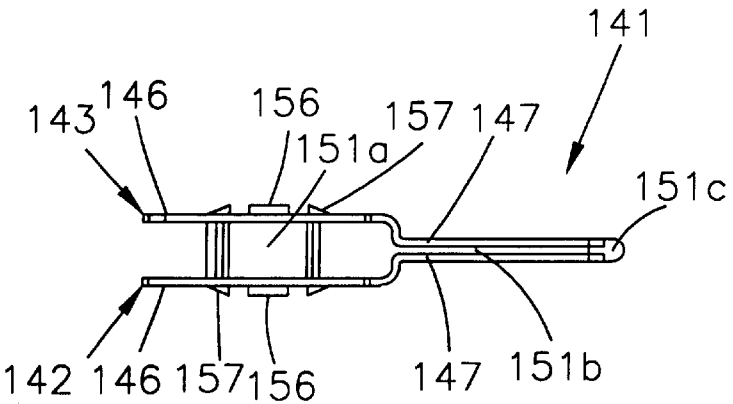
FIG. 12 is a top plan view of the split contact blade of FIG. 10 taken along the line 12—12 of FIG. 11.

The construction of second printed circuit board 37 is substantially similar to the construction of first printed circuit board 36. In this regard, second sheet 39 has opposite top and bottom planar surfaces 51 and a plurality of traces 52 formed on top surface 51 (see FIGS. 1 and 10). The spaced-apart parallel traces 52 include a plurality of power traces 52*a* and a plurality of signal traces 52*b*, each of which preferably correspond in number to power traces 46*a* and signal traces 46*b* of first printed circuit board 36, and a single ground trace 52*c*. An array of interconnect holes 53 substantially similar to interconnect holes 47 and preferably including one or more plurality of five longitudinally spaced-apart interconnect holes 53 extend through sheet 39 and the end of each power trace 52*a* and the ground trace 52*c*. A plurality of three longitudinally spaced-apart interconnect holes 54 extend through second sheet 39 and the end of each signal trace 52*b*.

Male connector 32 is formed from an elongate housing 61 extending along a longitudinal axis 62 and made from any suitable insulating or dielectric material such as a flame retardant plastic (see FIGS. 1–4). Male connector housing 61 has a first or front side 66, a second or bottom side 67, a third or rear side 68 and a fourth or top side 69. These sides extend parallel to longitudinal axis 62 and perpendicularly to each other so that housing 61 has a cross-sectional shape perpendicular to axis 62 that is rectangular. The housing 61 is further formed from left and right parallel ends 71 and 72 which extend perpendicularly to longitudinal axis 62. Housing 61 is adapted to mount to first printed circuit board 36 in a position overlying interconnect holes 47 and 48. In this regard, bottom side 67 is provided with a recess 73 extending longitudinally along the rear thereof and having a depth approximating the thickness of first sheet 38 for receiving end portion 41 of first printed circuit board 36. Recess 73 permits first printed circuit board 36 to seat relatively flush with bottom side 67 of male connector housing 61. A plurality of longitudinally spaced-apart stand-offs 74 extending perpendicularly to longitudinal axis 62 are provided on bottom side 67 for supporting housing 61 on first printed circuit board 36 between traces 46. In the embodiment illustrated, male connector housing 61 has a length measuring between ends 71 and 72 of approximately 3.7 inch, a height measured between top surface 43 of first printed circuit board 36 and top side 69 of approximately 0.5 inch and a depth measured between front and rear sides 66 and 68 of approximately one inch. However, male connector housing 61 can have a length ranging from approximately 0.5 to ten inches, a height ranging from approximately 0.5 to one inch and a depth ranging from approximately one to two inches. Housing 61 extends beyond end 42 of first printed circuit board 36 a distance ranging from approximately 0.25 to 0.75 inch.

Male connector housing 61 has an internal cavity 81 accessible by a rectangular-shaped opening 82 in front side 66 of the housing 61 (see FIG. 3). The front side 66 and the opening 82 therein are adjacent bottom side 67 of the housing 61. Cavity 81 is bordered by a circumferentially-extending wall formed by bottom and top walls 86 and 87 and left and right walls 88 and 89 of respective bottom and top sides 67 and 69 and left and right ends 71 and 72. A central wall 91 extending perpendicularly to walls 86–89 forms the rear of cavity 81. Thin walls 86–89 each have a thickness of approximately 0.04 inch. A plurality of ribs are provided in bottom and top sides 67 and 69 for providing support to bottom and top walls 86 and 87. In this regard, pairs of opposed bottom and top ribs 92 and 93 extend inwardly from respective walls 86 and 87 in longitudinally spaced-apart positions along the walls 86 and 87. Ribs 92 and 93 each extend transversely along the wall from central wall 91 to opening 82 in front side 66 and project inwardly into cavity 81 a distance of approximately 0.1 inch. The front surface of each rib 92 and 93 has a planar portion 94 which tapers inwardly from opening 82 toward central wall 91.

A plurality of male contact means or male electrical contacts 101 are carried by male connector housing 61 for transmitting electrical energy or power through male connector 32 (see FIGS. 3–9). Each of male electrical contacts or power contacts 101 is formed from a unitary electrical body 102 made from any suitable electrically conductive material such as a copper alloy and preferably phosphorous bronze. Unitary body 102 has a central portion 103 which is substantially square in shape and is formed from first and second spaced-apart central members 104, which are each substantially planar in construction and extend parallel to each other (see FIGS. 5–9). A blade member or blade 106 extends forwardly from central portion 103. The blade 106 is preferably plated with gold and is formed from first and second spaced-apart planar blade portions 107 which are joined respectively to first and second central members 104. The blade portions 107 are joined at the distal end of blade 106 by a rounded edge 108 extending vertically of the blade 106. The tops and bottoms of blade portions 107 taper toward each other adjacent rounded edge 108. An inwardly-extending protuberance 109 is formed in one of the blade portions 107 and extends inwardly to engage the other blade portion 107 for retaining the blade portions in spaced-apart positions and providing rigidity to the blade. Blade 106 of power contacts 101 has an area measured by the length and height of blade portions 107 and has a height ranging from approximately 0.25 to 0.50 inch and a length ranging from approximately 0.33 to 0.65 inch.

A plurality of pin members or pins 111 depend from the bottom of central portion 103 for cooperatively engaging interconnect holes 47 in first printed circuit board 36 (see FIG. 3). In this regard, a plurality of pins or tails 111 depend from each of central members 104 in spaced-apart positions across the bottom of the central member 104 and in a plane (see FIGS. 5–9). More specifically, a plurality of five contact terminals or tails 111 are spaced apart across the bottom of each central member 104 at equal spacings of approximately 0.1 inch. Each tail 111 has a width or thickness which closely approximates the diameter of the interconnect hole 47 into which it is to be inserted and is preferably plated with tin lead. As such, each power contact 101 has ten electrical tails 111 arranged in two rows having five tails 111 in each row. Blade 106 and tails 111 extend from central portion 103 in directions away from each other. More specifically, tails 111 extend at right angles to blade 106. A spacer is joined to at least one of central members 104 for retaining the central members in spaced-apart positions. More specifically, first and second spacer bands 112 bow inwardly from each of the first and second central members 104 to engage each other.

Figure 4:
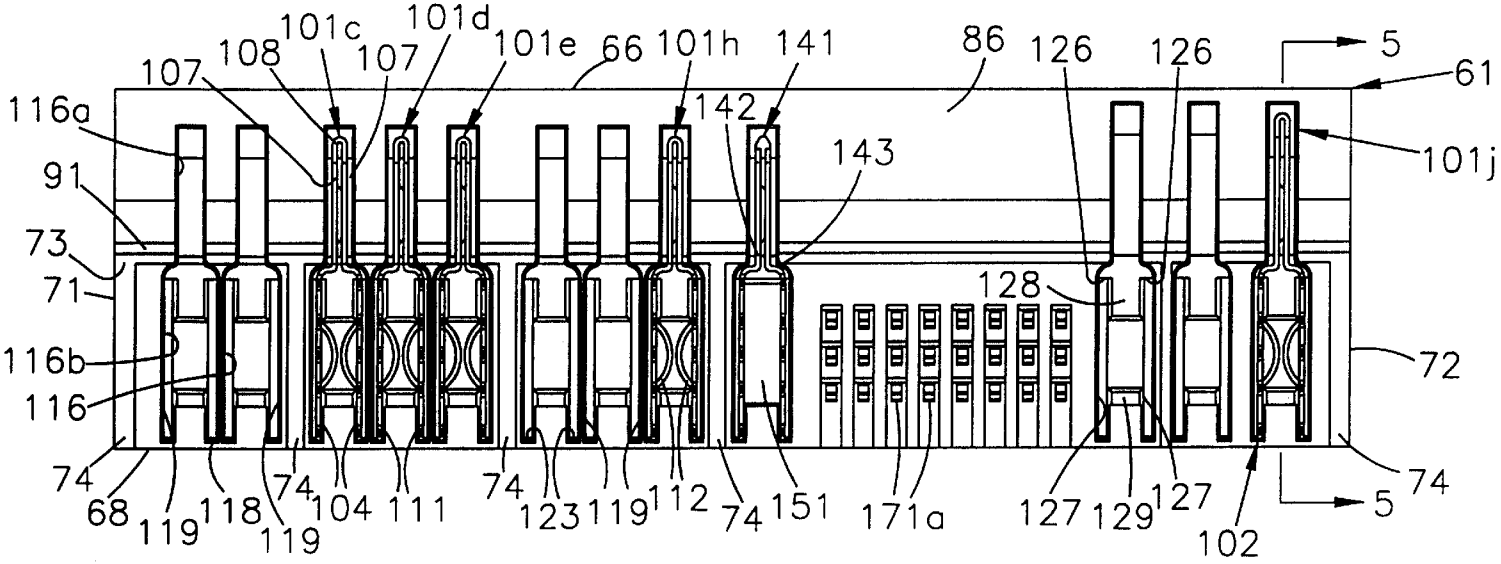
FIG. 4 is a bottom plan view of the male connector of FIG. 1 taken along the line 4—4 of FIG. 1.

Power contacts 101 are carried by male connector housing 61 so that blades 106 extend perpendicularly of longitudinal axis 62 in longitudinally spaced-apart and aligned positions within cavity 81 (see FIGS. 3 and 4). The forward rounded edge 108 of each blade 106 is disposed vertically within housing 61 so as to extend parallel to the plane of front side 66 and opening 82 therein. A plurality of longitudinally spaced-apart slots 116 extending perpendicularly to longitudinal axis 62 are formed in bottom side 67. Each of the slots 116 has a forward portion 116*a* formed in bottom wall 86 and a rear portion 116*b* opening into recess 73 of the bottom side 67. A vertically disposed slot 117 in longitudinal alignment with slot 116 is provided in central wall 91 for each of power contacts 101 (see FIGS. 3 and 4). Rear portion 116*b* of each slot 116 is formed at its forward end by central wall 91, at its rear by wall 118 forming rear side 68 and at its front by central wall 91 (see FIGS. 4 and 5). The extension of top wall 87 rearwardly of central wall 91 forms the bottom of each slot 116, while spaced-apart internal walls 119 extending perpendicularly to longitudinal axis 62 and joined to the inside of top wall 87, central wall 91 and rear wall 118 form the sides of each slot 116.

Each power contact 101 is inserted through bottom side 67 into a slot 116 for assembling male connector 32. First and second spaced-apart grooves 123 are provided in rear wall 118 adjacent each of internal walls 119 for guiding first and second central members 104 during insertion and aiding in spaced-apart positioning of the central members 104 thereafter (see FIGS. 4 and 5). Further retention and positioning of central portions 103 within slots 116 is provided by first and second spaced-apart forward grooves 126 and first and second spaced-apart rearward grooves 127 formed by respective forward and rearward protuberances 128 and 129 extending downwardly from top wall 87. The first and second forward grooves 126 and the first and-second rearward grooves 127 are disposed adjacent respective first and second internal walls 119.

First and second central members 104 of central portion 103 are each formed with an outwardly extending latch tab or clip 131 which is included within the cooperative means of power contacts 101 and male connector housing 61 for retaining the power contacts 101 within the housing 61 (see FIGS. 3 and 5–9). A cutout 132 is provided in each of internal walls 119 for forming a shoulder 133 upon which the free end of clip 131 abuts when the power contact 101 is fully inserted within male connector housing 61 (see FIG. 5). Forward and rearward guides 134 extend outwardly from each central member 104 adjacent clip 131 for protecting the clip during insertion of the power contact 101 into male connector housing 61. A plurality of notches 135 are formed in the rear of each central member 104 for engaging respective protuberances (not shown) within slot 116 for contributing to the mechanical retention of the power contact 101 within housing 61 and facilitating a press fit ease of assembly. Blades 106 of each power contact 101 pass through forward portion 116*a* of the respective slot 116 during such insertion of the power contact 101 into male connector housing 61.

Figure 5:
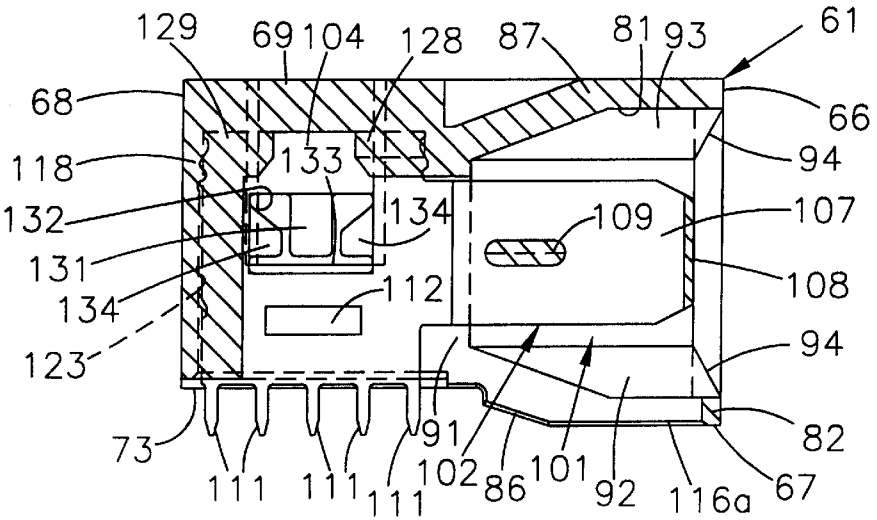
FIG. 5 is a cross-sectional view of the male connector of FIG. 1, taken along the line 5—5 of FIG. 4 and rotated 180°, showing a portion of one of the one-piece contact blades of the male connector.
Figure 8:
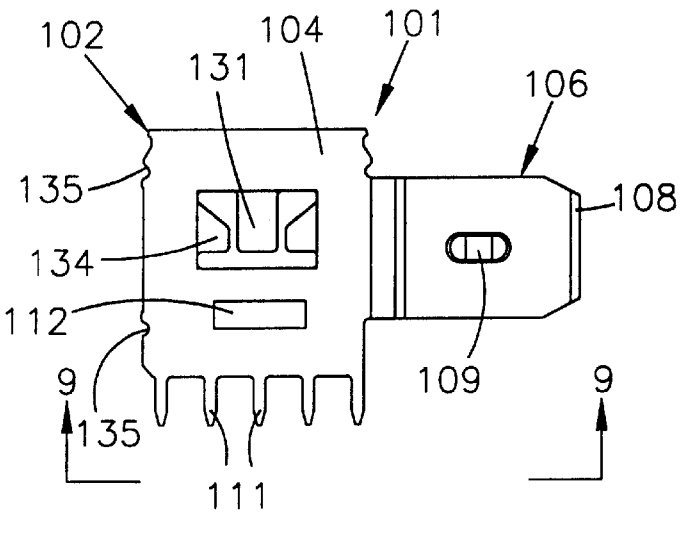
FIG. 8 is a second side elevational view of the one-piece contact blade of FIG. 6 taken along the line 8—8 of FIG. 7.
Figure 7:
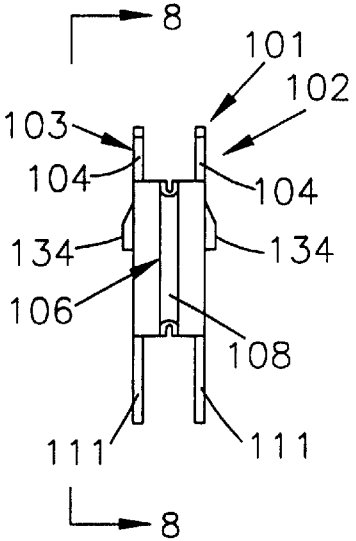
FIG. 7 is a front elevational view of the one-piece contact blade of FIG. 6 taken along the line 7—7 of FIG. 6.
Figure 6:
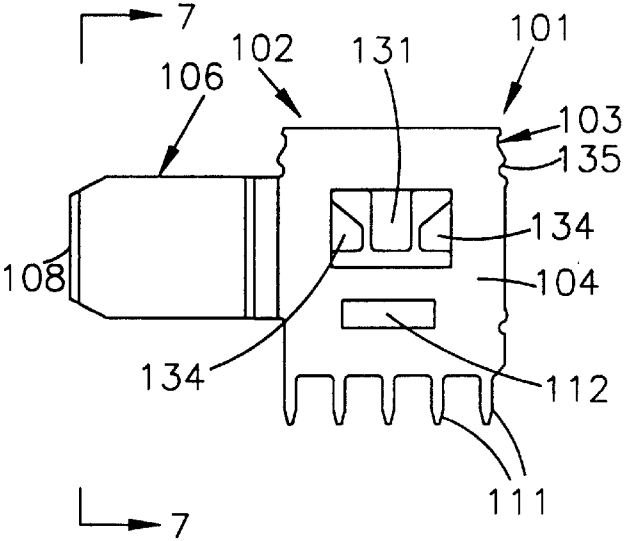
FIG. 6 is a first side elevational view of another of the one-piece contact blades of the male connector of FIG. 1 taken along the line 6—6 of FIG. 3.
Figure 9:
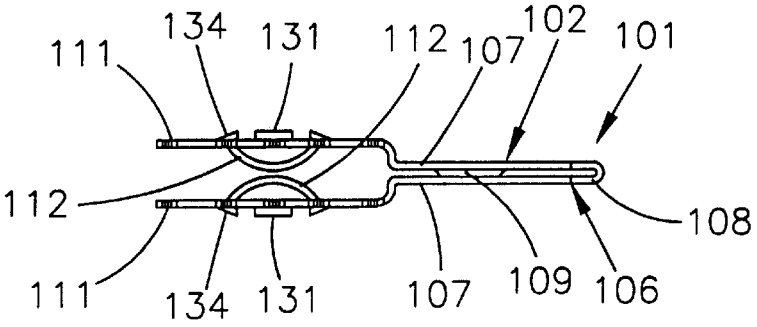
FIG. 9 is a bottom plan view of the one-piece contact blade of FIG. 6 taken along the line 9—9 of FIG. 8.
Figure 11:
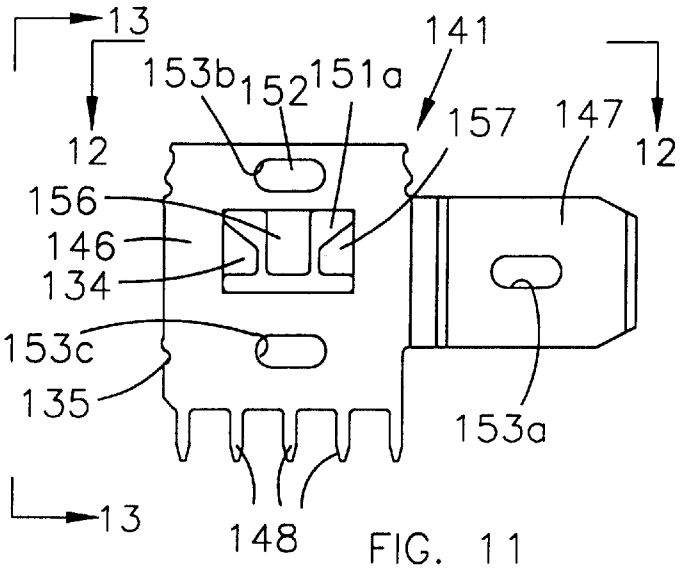
FIG. 11 is a side elevational view of the split contact blade of FIG. 10 taken along the line 11—11 of FIG. 10.
Figure 13:
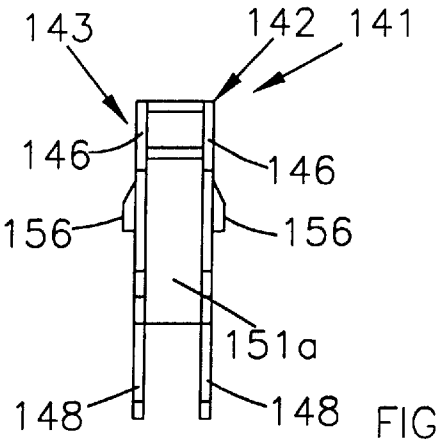
FIG. 13 is a rear elevational view of the split contact blade of FIG. 10 taken along the line 13—13 of FIG. 11.

Each blade 106 of a power contact 101 so inserted into and thereafter carried by male connector housing 61 is disposed completely within internal cavity 81 (see FIG. 5). The blades 106 of the power contacts 101 are arranged within cavity 81 in longitudinally spaced-apart positions and accessible from opening 82. Tails 111 extend from bottom side 67 into recess 73, as shown in FIG. 5, for disposition within respective interconnect holes 47 in first printed circuit boards 36. The tails 111 additionally serve to secure male connector housing 61 to first printed circuit board 36. Other suitable means such as an adhesive can be provided, in addition to or in lieu of tails 111, for securing the housing 61 to board 36.

A plurality of ten power contacts 101*a*–101*j*, numbered sequentially in FIG. 3 from left end 71 of male connector housing 61, are carried by the male connector housing 61. One or more power contacts 101 can be interconnected to each power trace 46*a* on first printed circuit board 36. For example, power contacts 101*a* and 101*b* are each interconnected with one of power traces 46*a*. Alternatively, a plurality of three power contacts 101 can be interconnected to a single power trace 46*a*, as shown by power contacts 101*c*–101*e* and power contacts 101*f*–101*h*, respectively, in FIG. 3. In further contrast, power contacts 101*i* and 101*j* are each interconnected to a single power trace 46*a*. A ground contact 136, substantially similar to power contacts 101, is also carried by male connector housing 61 and interconnected to ground trace 46*b* on first printed circuit board 36.

Power contacts 101 and ground contact 136 can have blades 106 of varying length. For example, as shown most clearly in FIG. 4, blades 106 of power contacts 101*a*–101*h* are shorter in length than blades 106 of ground contact 136 and power contacts 101*i*–101*j*. More specifically, the relatively short blades 106 of power contacts 101*a*–101*h* have a length of approximately 0.33 inch, while the relatively long blades 106 of ground contact 136 and power contacts 101*i*–101*j* have a length of approximately 0.41 inch. Forward portions 116*a* of slots 116 are sized longer for ground contact 136 and power contacts 101*i*–101*j* than for power contacts 101*a*–101*h,* as shown in FIG. 4.

An alternative embodiment of a male electrical contact having a blade such as blade 106 can be included within male connector 32 of connector assembly 31. For example, male connector 32 optionally has a male electrical contact assembly or power contact assembly 141 for carrying two distinct power supplies (see FIGS. 3 and 10–13). Power contact assembly 141 has similarities to power contact 101 and like reference numerals have been used to describe like components of power contact 101 and assembly 141. Power contact assembly or split blade assembly 141 is formed from first and second unitary bodies 142 and 143 which are mirror images of each other and are each made from any suitable material such as phosphorous bronze. Each of the bodies 142 and 143 has a central portion 146 having a size and shape similar to the central members 104 of power contacts 101. A blade member or blade 147 substantially similar to one of the halves of blade 106 extends forwardly from each of central portions 146. Although blades 147 are preferably of the same size and shape, the blades 147 can have any suitable height and length such as any of the heights and lengths discussed above for blades 106.

A plurality of pin members or tails 148 substantially similar to tails 111 or any of the other tails discussed above depend from each central portion 146 for cooperatively engaging interconnect holes 47 in first printed circuit board 36. In the embodiment of split blade assembly 141 illustrated in the drawings, a plurality of five contact terminals or tails 148 are spaced apart across the bottom of each central portion 146 in equal distances. Blade 147 extends away from tails 148 and, more specifically, extends at a right angle to each of the parallel-aligned tails 148.

A spacer element or spacer 151 made from plastic or any other suitable electrically insulating or dielectric material is disposed between first and second unitary bodies 142 and 143 for electrically insulating the bodies 142 and 143 from each other. Spacer or insulator 151 has a central part 151*a* disposed between a central portions 146 of first and second unitary bodies 142 and 143, a blade part 151*b* extending forwardly of central part 151*a* and disposed between the blades 147 of bodies 142 and 143 and a rounded edge 151*c* formed at the distal end of blade part 151*b*. The rounded edge 151*c* has a thickness greater than the thickness of blade part 151*b* so as to extend in front of the distal ends of each of blades 147 and thus form a smooth rounded distal end for split blade assembly 141.

A plurality of optional cylindrical protuberances 152, shown as being three in number, extend perpendicularly from each side of spacer 151 for attaching the spacer to first and second unitary bodies 142 and 143. Each of the protuberances 152 is press fit or otherwise received within a correspondingly sized and shaped hole 153 provided in a body 142 or 143. Specifically, a hole 153*a* is provided in each of blades 147 and top and bottom holes 153*b* and 153*c* are provided in each central portion 146 for receiving respective protuberances 152. Any suitable adhesive can also be used, in addition to or in lieu of protuberances 152, for securing the spacer 151 to first and second unitary bodies 142 and 143.

Split blade assembly 141 has a top, bottom and side profile corresponding to power contacts 101. As a result, a split blade assembly 141 has a size and shape which permits it to be inserted through a slot 116 in male housing 61. Split blade assembly 141 is secured within the male housing 16 in the same manner as discussed above with respect to power contacts 101. In this regard, a latch tab or clip 156 substantially identical to clip 131 extends outwardly from central portion 146 away from spacer 151 of each of first and second unitary bodies 142 and 143 for engaging a retention shoulder 133 provided in the male housing 61. The central portion 146 of each of first and second unitary bodies 142 and 143 is further provided with front and rear guides 157 substantially similar to guides 134 for protecting clip 156 during insertion of the split blade assembly 141 into male housing 61.

Tails 148 of each of the bodies 142 and 143 extend from bottom side 67 of male housing 61 for engaging interconnect holes 47 in first printed circuit board 36. Tails 148 of first unitary body 142 engage interconnect holes 53 in one power trace 52*a* and tails 148 of the second unitary body 143 engage the interconnect holes 53 in an adjacent second power trace 52*a*. The two distinct electrical contacts of split blade assembly 141 permit power from each of these distinct traces to be separately carried through split blade assembly 141 and thus male connector 32.

A plurality of additional male connector means or signal contacts 171 are carried by male connector housing 61. Each of the signal contacts 171, one of which is shown removed from male connector housing 61 in FIG. 3, is made from any suitable conductive material such as a copper alloy and preferably phosphorous bronze. The signal contacts 171 each have a tail portion or tail 171*a* and a pin portion or pin 171*b* extending at right angles to each other. In the embodiment of connector assembly 31 shown in the drawings, a plurality of twenty-four signal contacts 171 are provided. Contact terminals or tails 171*a* are arranged in eight rows with three tails in each row and each tail 171*a* has a transverse dimension which permits the tail to be inserted into an interconnect hole 48 with an interference fit. As such, a row of tails 171*a* is adapted to interconnect with the row of interconnect holes 48 provided in each signal trace 46*b*. Pins 171*b* are arranged within internal cavity 81 in eight longitudinally spaced-apart rows, each row having three spaced-apart pins 171*b* therein (see FIG. 3). Pins 171*b* are disposed completely within internal cavity 81. In this regard, the free end of each pin 171*b* is recessed inwardly of opening 82.

Female connector 33 is formed by an elongate female connector housing 176 made from any suitable insulating or dielectric material such as a flame retardant plastic and extends along a longitudinal axis 177. Housing 176 has a rectangular shape when viewed in plan and from the side and a size and shape for at least partially seating within internal cavity 81 when male connector 32 and female connector 33 are interconnected. More specifically, female connector housing 176 has a first or bottom side 178 formed by a bottom surface 179 adapted for mounting housing 176 to second printed circuit board 37. A second or top side 182 having a top surface 183 extending parallel to bottom surface 179 and opposite first and second sides 184 extending perpendicular to bottom and top sides 178 and 182 are further included within female connector housing 176. Each of sides 184 has a shoulder 186 extending longitudinally the length of the housing 176. A plurality of longitudinally spaced-apart standoffs 187 depend from bottom surface 179 for resting on top surface 51 of second printed circuit board 37 between traces 52. Female connector housing 176 is secured to second printed circuit board 37 in the same manner that male connector housing 61 is secured to first printed circuit board 36. The female connector housing 176 is sized to engage male connector housing 61 and, in the embodiment illustrated, has a length measured between its ends of approximately 3.7 inch, a height measured between bottom and top surfaces 179 and 183 of approximately 0.5 inch and a depth measured between sides 184 of approximately 0.52 inch.

A plurality of longitudinally spaced-apart grooves 191 are formed in each side 184 and extend perpendicularly to bottom and top surfaces 179 and 183. The grooves 191 of opposite sides 184 are longitudinally aligned with each other and with ribs 92 and 93 of male connector housing 61. The grooves 191 cooperatively engage respective ribs 92 and 93 at the beginning of the engagement of male and female connectors 32 and 33 and thereafter serve to guide the insertion of female connector housing 176 into internal cavity 81 of male connector housing 61. In this manner, ribs 92 and 93 and grooves 191 are included within the cooperative engagement means of connector assembly 31 for properly mating connectors 32 and 33.

Figure 14:
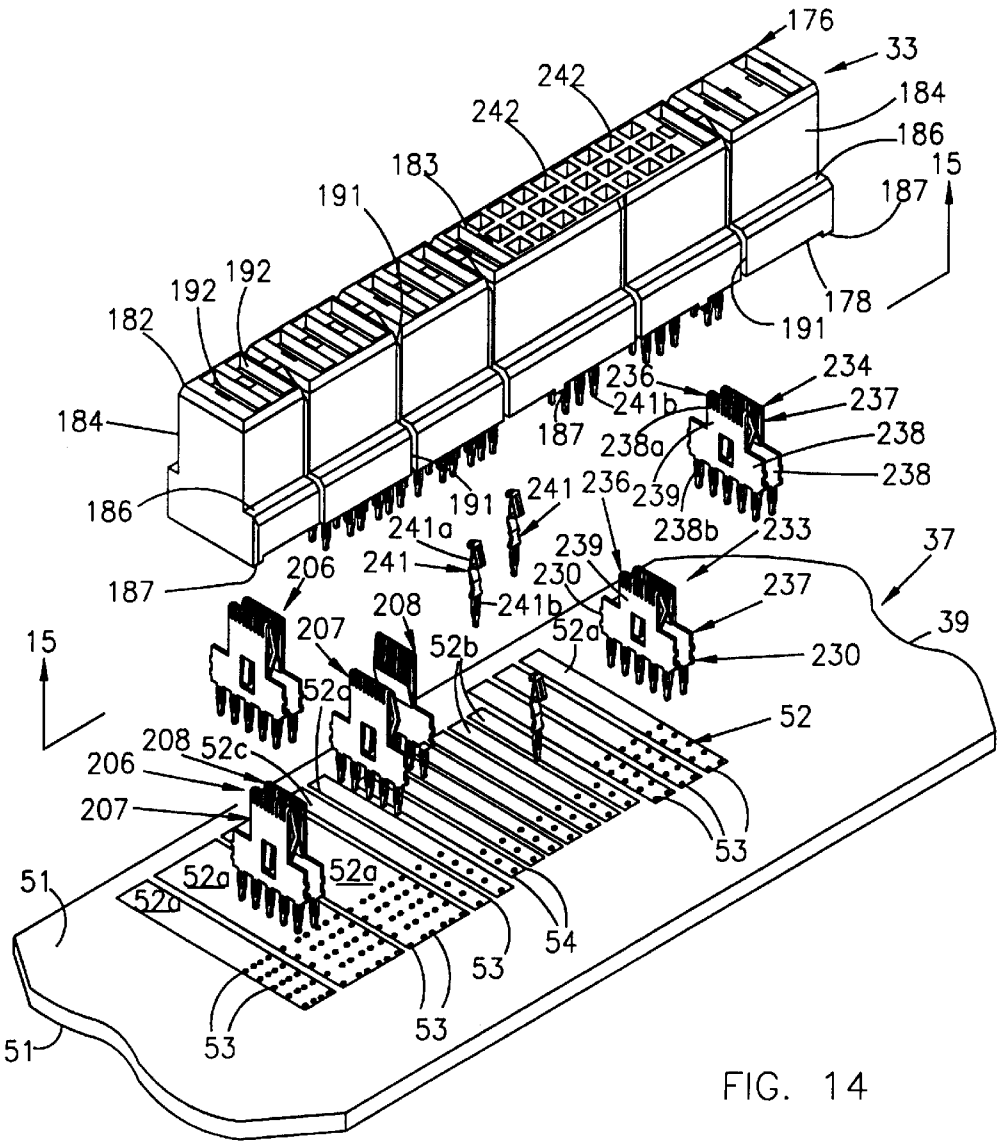
FIG. 14 is a partially exploded perspective view of the female connector of FIG. 1 taken generally along the line 14—14 of FIG. 1.
Figure 15:
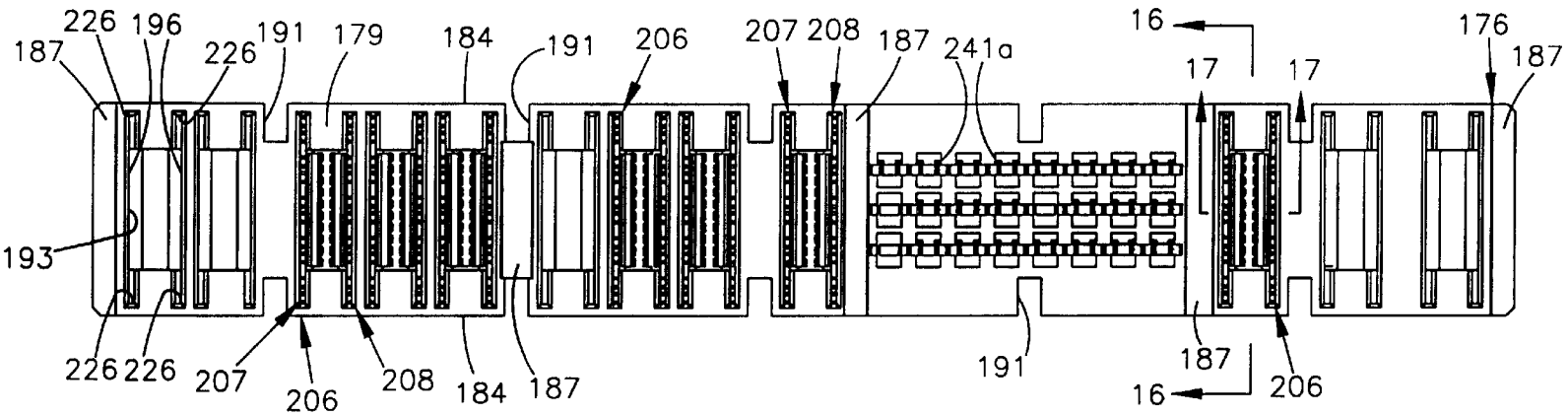
FIG. 15 is a bottom plan view of the female connector of FIG. 1 taken along the line 15—15 of FIG. 14.
Figure 17:
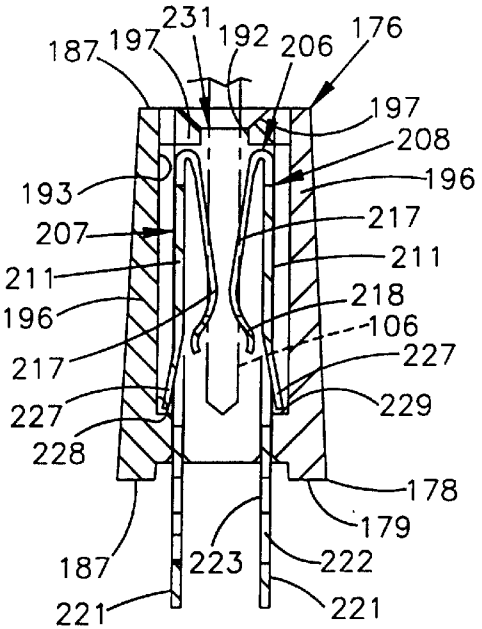
FIG. 17 is a cross-sectional view of the female connector of FIG. 1, taken along the line 17—17 of FIG. 15 and rotated 180°, showing a portion of one of the two-piece socket contacts of the female connector.
Figure 16:
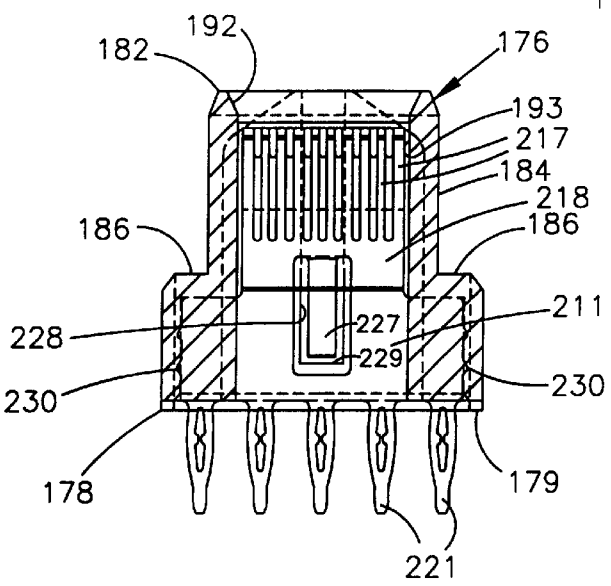
FIG. 16 is a cross-sectional view of the female connector of FIG. 1, taken along the line 16—16 of FIG. 15 and rotated 180°, showing one half of one of the two-piece socket contacts of the female connector.

A plurality of longitudinally spaced-apart openings 192 are provided in top surface 183 for receiving blades 106 of power contacts 101 and ground contact 136 (see FIGS. 1 and 14). Openings 192 are each rectangular in shape. A plurality of longitudinally spaced-apart slots 193, equal in number to openings 191 and in longitudinal alignment with the openings 192, extend through bottom surface 179. The openings 192 communicate with the bottoms of slots 193. Each of slots 193, as shown most clearly in FIGS. 15–17, is formed by first and second spaced-apart internal walls 196 extending perpendicularly between bottom side 178 and top side 182. A lip 197 extending parallel to longitudinal axis 177 projects inwardly from internal wall 196 at the base of slot 193 for forming each opening 192 (see FIG. 17).

Figure 19:
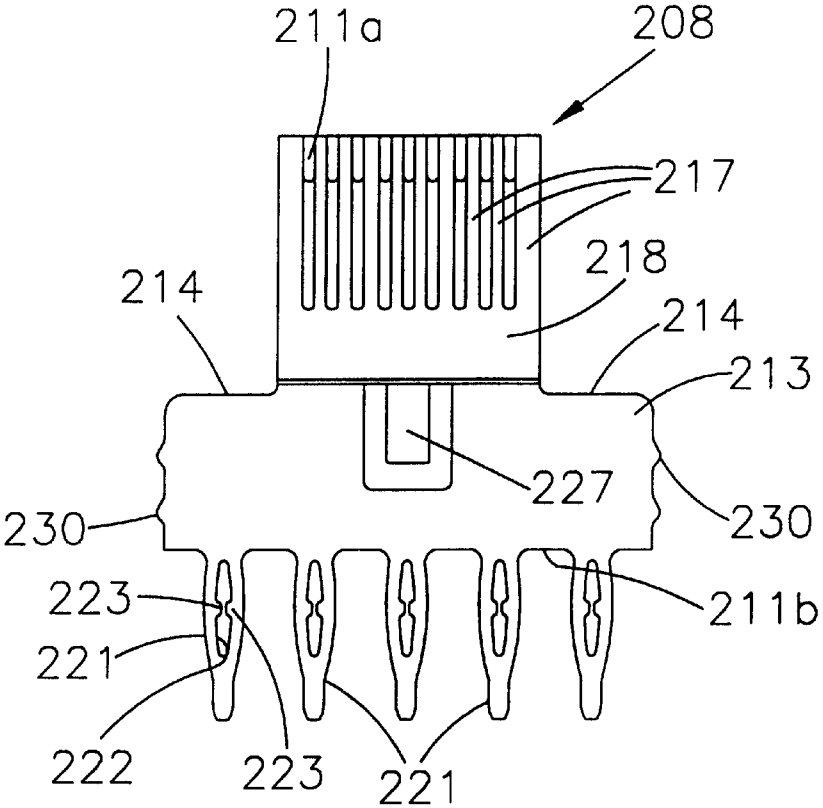
FIG. 19 is a front elevational view of the half socket contact of FIG. 18 taken along the line 19—19 of FIG. 18.
Figure 18:
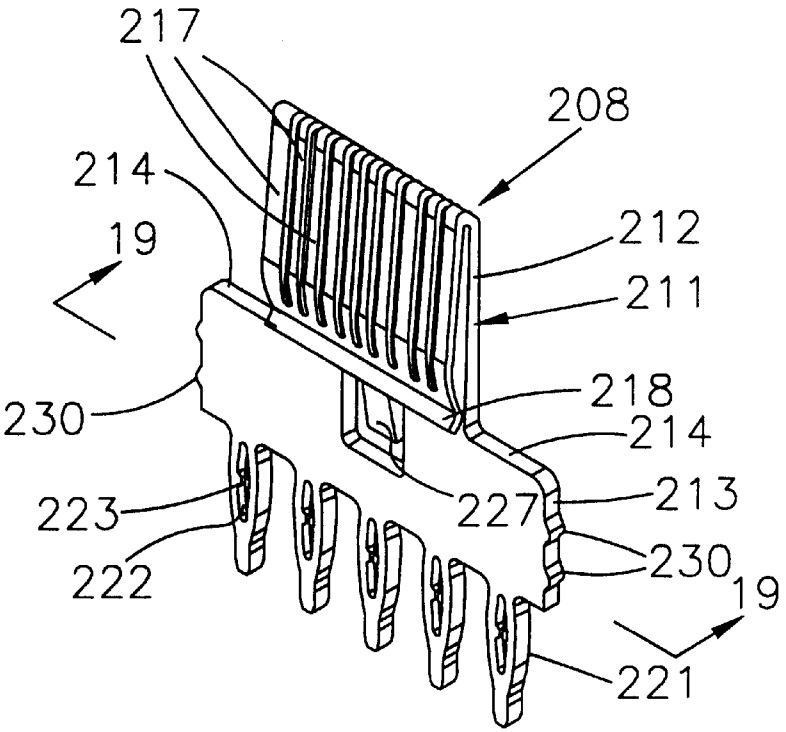
FIG. 18 is a perspective view of one half of one of the two-piece socket contacts, shown in FIG. 14, of the female connector of FIG. 1.

A plurality of female connector means or socket contact assemblies 206 are carried by female connector housing 176 for cooperatively receiving blades 106 of power contacts 101 and ground contact 136 (see FIGS. 17–19). Each socket assembly 206 is carried within a slot 193 of female connector housing 176 and is. formed from first and second unitary bodies made from any suitable electrically conductive material such as a copper alloy and preferably phosphorous bronze. Each of the bodies 207 and 208 is of a unitary construction and includes a central portion 211 extending substantially in a plane and having a first or top end 211*a* and an opposite second or bottom end 211*b*. Ends 211*a* and 211*b* extend parallel to each other. A top part 212 of central portion 211 is substantially square in shape and is joined to the center of a substantially rectangular-shaped bottom part 213 of the central portion. A shoulder 214 projects outwardly from each side of part 212 along the top of part 213.

A plurality of thin contact members 217 are secured to top end 211*a* of the central portion 211. The contact or spring members 217 are spaced apart across the width of top part 212 and have a width-to-spacing ratio ranging from a ratio of 1:5 to a ratio or 5:1 and preferably approximately 1.5:1. Each of the spring members 217 has as width-to-thickness ratio ranging from a ratio of 1:1 to a ratio of 5:1 and preferably approximately 2:1. Spring members 217 extend downwardly from the top end 211*a* toward the bottom end 211*b* over one planar face of top part 212 and have distal ends which are secured together by means of a strip 218 disposed parallel to top and bottom ends 211*a* and 211*b*. Each of the spring members extends gradually outwardly from top part 212 as it extends towards bottom end 211*b* and then arcs inwardly back toward the central portion 211 before joining strip 218, which is spaced in close proximity to the central portion. As such, each of the spring members 217 has a substantially bowed shape. The spring members 217 are preferably gold plated.

A plurality of thin members or tails 221 depend from central portion 211 (see FIGS. 14–19). Contact terminals or tails 221 are spaced apart across the width of the respective body 207 or 208 at intervals equal to the longitudinal spacing between the respective interconnect holes 53 in power traces 52*a* of second printed circuit board 37. Although one or any plurality of tails 221 can be provided, in one preferable embodiment a plurality of five equally spaced-apart tails 221 are provided in each of bodies 207 and 208. Each of tails 221 is plated with tin lead and is shown as being oblong in shape with a corresponding oblong hole 222 in the center thereof The oblong shape of the tail provides a thickness at the elevational center of the tail which is greater than the internal diameter of the corresponding interconnect hole. First and second opposing protuberances 223 extend into each side of the hole 222. During insertion of a tail 221 into an interconnect hole 53, the opposed protuberances 223 of the tail approach each other and touch in response to the circumferential insertion force exerted on the tail by second sheet 39. The reduced thickness of the tail after insertion remains slightly larger than the internal diameter of the corresponding interconnect hole so as to provide a tight interference fit after such complete insertion of the tail. It should be appreciated that tails 221 can have a variety of shapes such as the shape of tails 111 and conversely that tails 111 can have a variety of shapes such as the shape of tails 221 and be within the scope of the present invention.

First and second unitary bodies 207 and 208 of each socket assembly 206 are inserted into female connector housing 176 so that spring members 217 of the bodies 207 and 208 are in an opposed but spaced-apart configuration (see FIG. 17). The housing 176 is provided with first and second spaced-apart grooves 226 extending into the housing at each end of each slot 193 for receiving the first and second unitary bodies 207 and 208. Grooves 226 serve to guide the bodies 207 and 208 into the housing 176 and thereafter retain the bodies 207 and 208 in properly spaced-apart positions. The means for retaining first and second unitary bodies 207 and 208 of a socket assembly 206 within a slot 193 further includes a latch tab or clip 227 substantially similar to clip 131 formed in central portion 103 of power contacts 101. A cutout 228 is provided in each internal wall 196 for forming a shoulder 229 upon which the clip 227 seats when the unitary body 207 or 208 has been fully inserted into female connector housing 176. Such retaining means further includes at least one protuberance 230 formed on each side of bottom part 213 for engaging a respective notch provided in slot 193 to assist in the press fit assembly of socket assembly 206 within housing 176.

A socket portion 231 is formed by the opposed spring members 217 of each pair of first and second unitary bodies 207 and 208 when the bodies 207 and 208 are operationally disposed within female connector housing 176 as shown in FIG. 17. The socket portion 231 is adapted to sandwich a blade 106 of a power contact 101 or ground contact 136, shown in dashed lines in FIG. 17, therebetween when male and female connectors 32 and 33 are in a fully engaged position as shown in FIG. 2. During the insertion of a blade 106 into a socket portion 231, spring members 217 are compressed towards their respective central portions 103. The individual spring members accommodate any irregularities in the planarity of the blade 106 and thus provide that a significant surface area of the spring members 217 are engaged with the planar surfaces of the blade 106 so as to facilitate the transmission of power between socket portion 231 and blade 106. The multiplicity of contacts provided by spring member 217 additionally permits lower insertion and withdrawal forces. Spring members 217 also provide multiple paths of conductivity which results in the spring members having a high electrical conductivity.

The number of socket assemblies 206 interconnected to a trace 52 on second printed circuit board 37 can vary in the same manner as discussed above with respect to power contacts 101 and ground contact 136. More specifically, one or more socket portions 206 can be interconnected to a single trace 52. In addition, a single unitary body 207 or 208 can be interconnected to a trace 52 of second printed circuit board 37.

Female connector 33 can have socket assemblies with other sizes or configurations and be within the scope of the present invention. For example, as shown most clearly in FIG. 14, first and second shortened socket assemblies 233 and 234 are carried by female connector housing 176 for engaging the long-bladed power contacts 101*i* and 101*j* in male connector 32. The socket assemblies 233 and 234 each have similarities to socket assembly 206 and like reference numerals have been used to describe like components of socket assemblies 206, 233 and 234. Each of the shortened socket assemblies 233 and 234 has first and second unitary bodies 236 and 237 that are substantially similar to first and second unitary bodies 207 and 208 of each socket assembly 206 except that the central portion 238 of each body 236 and 237 has a top part 239 that is shorter in height than top part 212 of central portion 211. As a result, top end 238a of central portion 238 is closer to bottom end 238*b* than the comparable ends of central portion 211. Spring members 217 of the shortened socket assemblies 233 and 234 extend farther down the respective body 236 or 237 than the spring members extend down bodies 207 and 208 of socket assemblies 206. More specifically, the spring members 217 of shortened socket assemblies 233 and 234 extend downwardly from top end 238*a* to a position approaching bottom end 238*b*. A plurality of tails 221 and as shown a plurality of five tails 221 depend from central portion 238.

A plurality of additional female connector means or signal socket contacts 241 are carried by female connector housing 176 for cooperatively engaging signal contacts 171 of male connector housing 61 when male and female connectors 32 and 33 are interconnected or engaged. As shown most clearly in FIG. 14, where several signal socket contacts 241 are shown separate from female connector housing 176, each signal socket contact 241 has a socket portion or socket 241*a* and a tail portion or tail 241*b*. Each contact terminal or tail 241*b* is substantially similar to tail 221 and is sized and shaped for insertion into an interconnect hole 54 of second printed circuit board 37. Each socket 241*a* is U-shaped for cooperatively engaging a pin 171*b* of a signal contact 171. Female connector housing 176 is provided with a plurality of openings 242 in top surface 183 for receiving pins 171*b* of signal contacts 171. Openings 242 and underlying signal socket contacts 241 are arranged in female connector housing 176 in eight longitudinally spaced-apart rows, with three openings 242 and signal socket contacts 241 in each row. Sockets 241*a* of the signal socket contacts 241 are disposed within female connector housing 176 so as to be in communication with respective openings 242. Tails 241*b* extend from bottom surface 179 of the female connector housing 176 in a similar array of eight rows with three tails in each row for aligning with the similarly arranged interconnect holes 54 in signal traces 52*b* of the second printed circuit board 37.

In operation and use, second printed circuit board 37 having one or more female connectors 33 mounted thereon can be utilized as a mother board or other board within a computer housing. First printed circuit board 36 having male connector 32 thereon can be removably attached to the second printed circuit board 37 by means of the cooperative engagement of male connector 32 with female connector 33. In this regard, first printed circuit board 36 is moveable between a first or spaced-apart position relative to second printed circuit board 37 to a second position in which male connector 32 is in full cooperative engagement with female connector 33. One such first position is shown in FIG. 1 where first printed circuit board 36 is disposed perpendicularly to second printed circuit board 37 and the male and female connectors 32 and 33 are spaced apart. The second or engaged position of connectors 32 and 33 is shown in FIG. 2 where female connector 33 is disposed fully inside male connector 32.

In one preferred application for connector assembly 31, first printed circuit board 36 can be attached to a power supply. Alternating current is provided at first and second shortened socket assemblies 233 and 234 in female connector 33. The shortened socket assemblies 233 and 234 permit the female connector 33 to meet appropriate electrical isolation requirements for high voltages by positioning the socket assemblies 233 and 234 the necessary distance below top side 182 of female connector housing 176. The alternating current is input to first printed circuit board 36 by means of power contacts 101*i* and 101*j*. Direct current is output from the first printed circuit board 36 by means of power contacts 101*a* through 101*h*.

Figure 20:
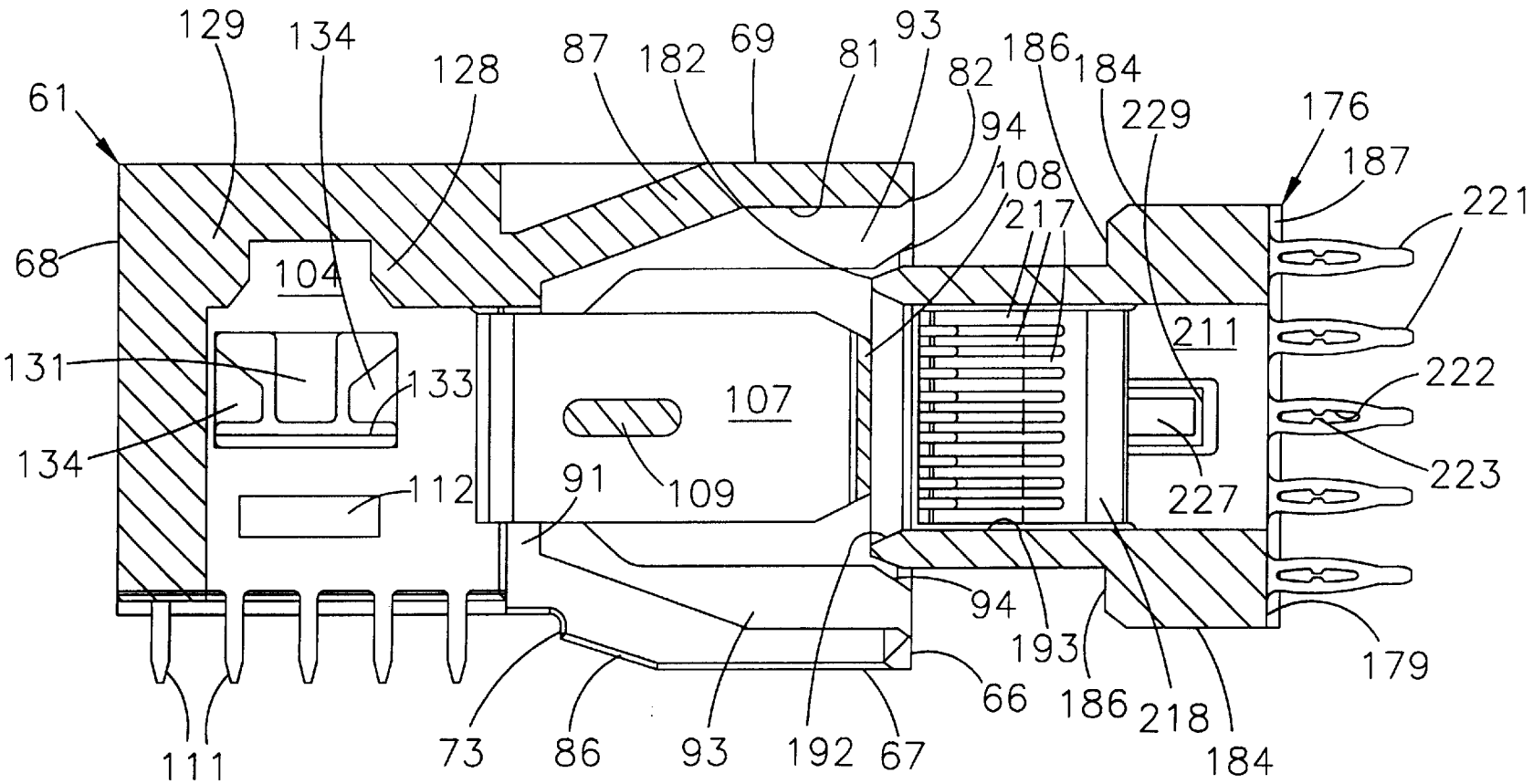
FIG. 20 is a cross-sectional view of the male and female connectors of FIG. 1 commencing engagement.

During the initiation of engagement between male and female connectors 32 and 33, the tapered end surface 94 of the internal ribs 92 and 93 of male connector 32 engage top side 182 of female connector housing 176 to transversely align the female connector housing 176 relative to the male connector housing 61 (see FIG. 20). Ribs 92 and 93 of male connector 32 and grooves 191 of female connector 33 serve to longitudinally align the female connector housing 176 for insertion into male connector housing 61. FIG. 20 further illustrates how ribs 92 and 93 engage female connector 33 prior to engagement of power contacts 101 and ground contact 136 with the respective socket assemblies 206, 233 and 234 of the female connector. The cooperative engagement of ribs 92 and 93 and grooves 191 further serves to guide the female housing 176 fully into male housing 61.

During the engagement of male and female connectors 32 and 33, blades 106 of power contacts 101 and ground contact 136 enter openings 192 in female connector housing 176 so that the blades 106 engage respective socket assemblies 206. Pins 176*b* of signal contacts 171 enter openings 242 in female connector housing 176 so as to engage signal socket contacts 241 disposed within the housing 176. As discussed above, blades 106 of power contacts 101 and ground contact 136 and central portions 211 and 238 of socket assemblies 206, 233 and 234 can be appropriately sized so as to stage the engagement of respective blades 106 and socket portions 231 in a desired manner. For example, blade 106 of ground contact 136 and central portion 211 of the corresponding socket assembly 206 into which the ground contact blade 106 is inserted are both sized relatively long so that a ground contact is the initial electrical contact made between male connector 32 and female connector 33 during engagement.

Upon such engagement of male and female connectors 32 and 33, power can be transmitted between first printed circuit board 36 and second printed circuit board 37 by means of power contacts 101 and socket assemblies 206, 233 and 234 in the manner discussed above. One or more power contacts 101 can be utilized for transmitting or receiving a distinct power supply between male connector 32 and female connector 33. In this regard, a power trace 46a having a single power contact 101, two power contacts 101 or three power contacts 101 secured thereto are utilized in male connector 32. Corresponding configurations of socket assemblies 206, 233 and/or 234 with respect to power traces 52*a* are utilized in female connector 33. Male connector 32 additionally has a split blade assembly 141 for transmitting or receiving two distinct power supplies through an assembly having the size and shape of a single power contact 101. In the one preferred application discussed above, a power supply from one power trace 146*a* is transferred by means of one side blade 147 of the split blade assembly 141 to one first unitary body 207 of a socket assembly 206 in female connector housing 176 to a power trace 52*a* on second printed circuit board 37. A second distinct power supply from another power trace 46*a* on first printed circuit board 36 is. transferred by means of the other half plate 147 of split blade assembly 141 to second unitary body 208 in female connector housing 176 to a second power trace 52*a* on second printed circuit board 37. The number of power blade contacts 101, and/or portions thereof through utilization of split blade assembly 141, is dependent upon the amount of power required to pass through connector assembly 31. In this regard, the current flow permitted through each tail 111, 148, 221 and 266 can range from one to six amperes per tail and preferably range from three to five amperes per tail.

The utilization of one or more sets of five spaced-apart tails 111 in male connector 32 for cooperatively engaging with interconnect holes 47 in power traces 46a on first printed circuit board 36 permits a greater current density to be transmitted through each of power contacts 101 than in electrical contacts having fewer tails thereon. Similarly, the use of one or more sets of five spaced-apart tails 221 in the sockets assemblies 206, 233 and 234 of female connector 33 increases the current density that can be carried by the socket assemblies. Control signals or other electrical signals can be transmitted from male connector 32 to female connector 33 or vise versa by means of the cooperative engagement of signal contacts 171 in male connector 32 and signal socket contacts 241 in female connector 233.

Although second printed circuit board 37 is shown as having only a single female connector 33 mounted thereon, it should be appreciated that a plurality of female connectors 33 can be mounted in spaced-apart or other positions on a second printed circuit board and be within the scope of the present invention. The low profile of male connector 32 relative to first printed circuit board 36, that is the relatively small height of the male connector 32 above circuit board 36, permits such a compact stacking of first printed circuit boards 36 on second printed circuit board 37. The complete insertion of female connector 33 within male connector 32 during full engagement of the connectors 32 and 33, as shown in FIG. 2, contributes to the low profile characteristic of assembly 31. The relative thinness of walls 86–89 forming opening 32 and internal cavity 81 also contribute to the low profile of connector assembly 31. Ribs 92 and 93 on the inside of bottom and top walls 86 and 87 enhance the stiffness of walls 86–89 and thus facilitate male connector housing 61 having a wall of such reduced thickness.

Connector assembly 31 is also relatively compact in length. The relatively dense longitudinal spacing of blades 106 within internal cavity 81 permits such a small length. In addition, the relatively high current density of power contacts 101 and split blade assembly 141, permitted in part by the utilization of five tails 111 or 148 on such electrical contacts, permits a fewer number of electrical contacts to be utilized for a given aggregate current density.

Blades 106 of power contacts 101 and ground contact 136 and pins 171*b* of signal contacts 171 are each recessed fully within internal cavity 81. The circumferentially-extending walls 86–89 protect blades 106 and pins 171*b* when male connector 31 is disengaged from female connector 33. This circumferential protection and recessing of the blades 106 additionally serves to protect against unwanted shorts between blades 106 and pins 171*b* when first printed circuit board 36 is disengaged from second printed circuit board 37.

Power contacts 101 and ground contact 136 are each made from an integrated body of an electrically conductive material. The utilization of a single body as opposed to an assembly of conductive parts reduces the overall resistivity and thus increases the efficiency of the electrical contact. Similarly, first and second unitary bodies of each socket assembly 206 and first and second unitary bodies of each socket assembly 233 and 234 are each formed from a single integrated body of an electrically conductive material so as to increase the electrical efficiency of these socket assemblies.

Figure 22:
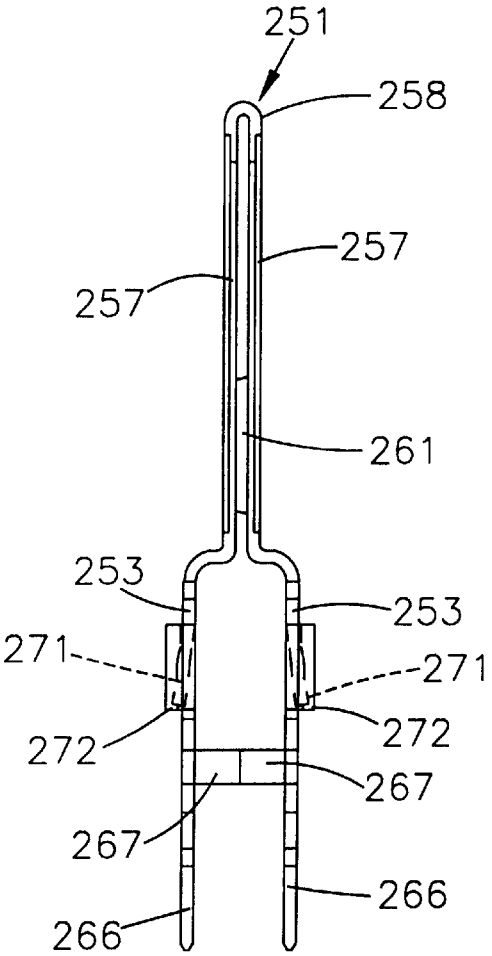
FIG. 22 is a second side elevational view of the one-piece contact blade of FIG. 21 taken along the line 22—22 of FIG. 21.
Figure 21:
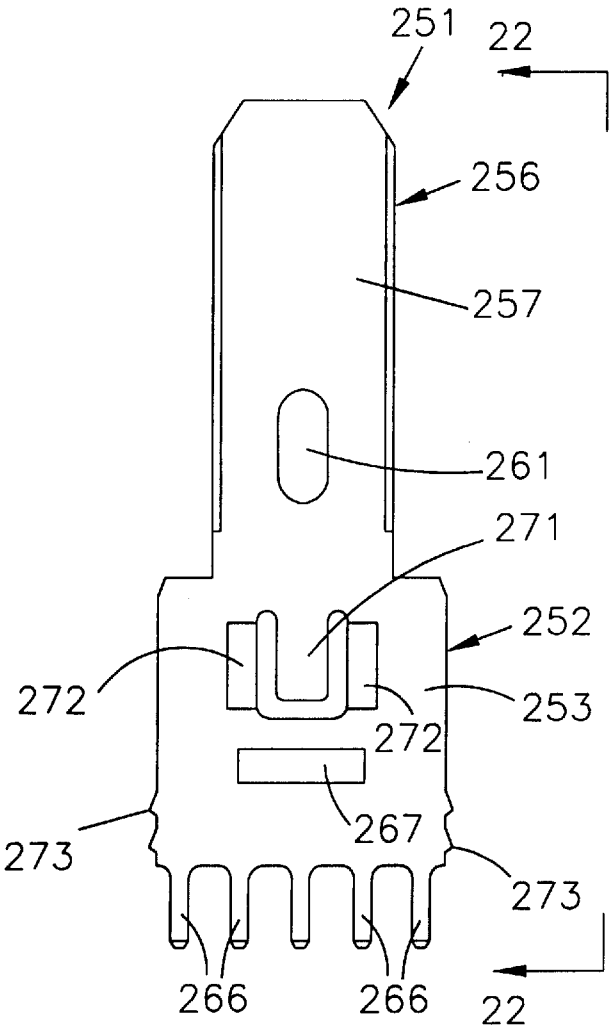
FIG. 21 is a first side elevational view of an other embodiment of a one-piece contact blade of the present invention.

Connector assemblies having other sizes and shapes and utilizing features of connector assembly 31 are within the scope of the present invention. It should be appreciated, for example, that any combination of power contacts 101 and split blade assemblies 141, and corresponding combinations of socket assemblies 206, 233 and 234, can be provided in a connector assembly of the present invention. In another embodiment, a connector assembly of the present invention can be provided in which power blades extend in directions parallel to the directions of tails 111. A suitable electrical contact for use in the male connector of such an assembly is shown in FIGS. 21 and 22. Male contact means or electrical contact 251 shown therein is substantially similar to power contact 101 and ground contact 136 and can be utilized either for transferring power or as a ground.

Electrical or blade contact 251 has a central portion 252 which is substantially square in shape and is formed from first and second spaced-apart central members 253, which are each substantially planar in construction and extend parallel to each other. A blade member or blade 256 extends upwardly from central portion 252. Blade 256 is preferably plated with gold and is formed from first and second spaced-apart planar blade portions 257 that are joined respectively to first and second central members 253. Blade portions 257 are joined at the distal or upper end of blade 256 by a rounded edge 258 extending horizontally of the blade 256. The left and right surfaces of blade portions 257 taper toward each other adjacent rounded edge 258. An inwardly-extending protuberance 261 substantially similar to protuberance 106 of power contact 101 is formed in one of blade portions 257 for retaining the blade portions in spaced-apart positions. Blade 256 can have a height and an area similar to blades 106.

A plurality of pin members or pins 266 substantially similar to pins or tails 111 depend from each of central members 253 in spaced-apart positions across the bottom of the central member. In the embodiment of the straight blade contact 251 shown in FIGS. 21 and 22, a plurality of five pins or tails 266 are spaced apart across the bottom of each central member 253 in equal distances. Contact terminals or tails 266 of each central member 253 are disposed in a plane which extends parallel to the plane of blade 256. First and second spacer bands 267, substantially similar to spacer bands 112 discussed above, bow inwardly from each of the first and second central members 253 to engage each other and thus retain the central members in spaced-apart positions.

A male connector housing for carrying blade contacts 251 can be substantially similar to male connector housing 61 except that internal cavity 81 opens onto a side opposite the side from which tails 266 extend. Means for retaining each blade contact 251 within the male connector housing includes a latch tab or clip 271 substantially similar to clip 131. First and second guides 272 substantially similar to guides 134 are provided for protecting clip 271 during insertion of the blade contact into the male connector housing. Such retaining means further includes at least one protuberance 273 formed on each side of the central members 253 for engaging respective notches within the male connector housing and thus facilitating a press fit into the housing for ease of assembly. Blade contact 251 can be utilized with any suitable female connector such as female connector 33.

From the foregoing, it can be seen that a new connector assembly for attachment to first and second printed circuit boards and carrying electrical power and/or electrical signals has been provided. The connector assembly is relatively small in size and has a relatively small profile with respect to the printed circuit boards. The electrical contacts utilized in the connector assembly are formed from a minimal number of parts so as to reduce the resistivity of the electrical contacts. Male electrical contacts having blades for carrying power are included in the connector assembly. The blades are circumferentially protected when disengaged. A split blade assembly for carrying first and second distinct power supplies can be optionally included in the connector assembly.

What is claimed is:

1. A connector for use with a printed circuit board having a plurality of traces extending to an array of interconnect holes comprising a connector housing adapted for mounting to the printed circuit board in a position overlying the array of interconnect holes and at least one male connector means of an electrically conductive material carried by the male connector housing, the male connector means formed from a unitary body having first and second blade members and first and second central members, each of the first and second blade members extending in juxtaposition and having first and second ends, the first ends of the first and second blade members being joined together to form a forward end of the male connector means and the second ends of the first and second blade members being joined to respective first and second central members, the first and second central members being spaced apart and each having an end, the unitary body including a plurality of pin members extending from the end of each of the first and second central members for engaging the array of interconnect holes in the circuit board.

2. A connector as in claim 1 wherein each of the first and second blade members extends at approximately right angles to the respective pin members.

3. A connector as in claim 1 wherein each of the first and second blade members extends parallel to the respective pin members.

4. A unitary male electrical contact for use in a male connector housing of a connector assembly mountable on a printed circuit board having at least one power-carrying trace that extends to an array of interconnect holes to engage a female electrical contact in a female connector housing of the connector assembly comprising a unitary body of an electrically conductive material adapted to be carried by the male connector housing, the unitary body having first and second blade members and first and second central members, each of the first and second blade members extending in juxtaposition and having first and second ends, the first ends of the first and second blade members being joined together to form a forward end of the male connector means and the second ends of the first and second blade members being joined to respective first and second central members, the first and second central members being spaced apart and each having an end, the unitary body including a plurality of pin members extending from the end of each of the first and second central members for engaging the array of interconnect holes in the circuit board.

5. The male electrical contact of claim 4 wherein the pin members extend at right angles to the respective blade member.

6. The male electrical contact of claim 4 wherein the pin members extend in directions parallel to the respective blade member.

7. The male electrical contact of claim 4 wherein each of the first and second blade members is substantially planar.

8. The male electrical contact of claim 4 wherein each of the first and second central members is substantially planar.

9. The male electrical contact of claim 4 wherein the pin members extending from each of the first and second central members includes a plurality of five pin members disposed in a row.

* * * * *